United States Patent [19]

Knox

[11] 4,156,071

[45] May 22, 1979

[54] POLY(ETHYLENE TEREPHTHALATE) FLAT YARNS AND TOWS

[75] Inventor: Benjamin H. Knox, Kinston, N.C.

[73] Assignee: E. I. Du Pont de Nemours and Company, Wilmington, Del.

[21] Appl. No.: 912,865

[22] Filed: Jun. 5, 1978

Related U.S. Application Data

[63] Continuation-in-part of Ser. No. 832,660, Sep. 12, 1977, abandoned.

[51] Int. Cl.[2] ..... C08G 63/18; C08G 63/70

[52] U.S. Cl. ..... 528/272; 57/246; 264/210 F; 528/309

[58] Field of Search ..... 528/272; 264/210 F; 57/157 TS

[56] References Cited

U.S. PATENT DOCUMENTS

| | | | |
|---|---|---|---|
| 3,739,056 | 6/1973 | Evans et al. | 264/290 T |
| 3,772,872 | 11/1973 | Piazza et al. | 264/210 F |
| 3,946,100 | 3/1976 | Davis et al. | 264/210 F |
| 3,977,175 | 8/1976 | Yoshikawa et al. | 57/157 TS |

*Primary Examiner*—Lucille M. Phynes

[57] ABSTRACT

New poly(ethylene terephthalate) flat yarns and tows having physical properties and dyeability more akin to cellulose acetate than to conventional poly(ethylene terephthalate) flat yarns are prepared directly by spinning at speeds of about 4000 meters/minute. Among the useful physical properties are a modulus of 30 to 65, which is relatively unaffected by boiling, low boil-off shrinkage, no need for heat setting, low shrinkage tension, large crystal size, and low amorphous orientation which is measured by a value termed "amorphous modulus." The flat yarns may be used, e.g. in textile fabrics, without drawing, and may be modified, e.g. by air-jet texturing. The tows may be converted into staple fiber.

83 Claims, 3 Drawing Figures

POLY(ETHYLENE TEREPHTHALATE) FLAT YARNS AND TOWS

CROSS-REFERENCE TO RELATED APPLICATION

This application is a continuation-in-part of application Ser. No. 832,660, filed Sept. 17, 1976, now abandoned.

BACKGROUND OF THE INVENTION

This invention concerns new polyester filaments, having properties that make them especially suitable for use as a replacement for cellulose acetate in "flat" yarns and in continuous filament tows, and new polyester staple fiber, and their production.

Polyester continuous filaments have been prepared commercially for many years, and are now manufactured in very large quantities for use as continuous filament yarns and tows. The tow is generally crimped and converted to staple fiber which is drafted and twisted into "spun" yarns, or may be converted to staple for other uses, e.g. flock. Continuous filament polyester yarns are frequently textured to impart a "spun-like" tactility, usually by false-twist texturing, but may alternatively be used without texturing, in which case they are often referred to as "flat" yarns. Most commercial manufacture has been of poly(ethylene terephthalate) because of the physical properties and economic advantages of this synthetic filamentary material. Most of the commercial yarn is processed into fabrics for apparel purposes, and is therefore dyed at some stage.

It is well recognized, however, that poly(ethylene terephthalate) is more difficult to dye than other filamentary materials, such as cellulose acetate, so special dyeing techniques have been used commercially, e.g. dye bath additives called "carriers" have been used to dye the homopolymer, usually at higher pressures and temperatures, or the chemical nature of the polyester has been modified to increase the rate of dyeing, e.g. by introducing tetramethylene groups, or to introduce dye-receptive groups, e.g. as discussed in Griffing & Remington U.S. Pat. No. 3,018,272. These special techniques involve considerable expense, and it has long been desirable to provide poly(ethylene terephthalate) filaments having useful physical properties, e.g. for apparel and home furnishing applications, but which can be dyed at the boil (i.e., without requiring superatmospheric pressure and apparatus suitable for such pressure) within a reasonable period of time without carriers. Although all physical and chemical properties of textile yarns should be considered, the most important physical properties are generally the tensile and shrinkage properties.

The tensile properties of commercial (drawn) flat polyester yarns have been satisfactory for many textile purposes, and are generally of the approximate order: tenacity 4 grams per denier; elongation 30%; (initial) modulus 100 grams per denier in as-produced condition, but 50 to 65 grams per denier after boiling in a relaxed state. Although the elongation is usually given, the modulus is often of more significance in determining suitability for particular textile purposes. The high modulus of existing commercial polyester yarns has been considered important for many textile purposes. Cellulose acetate, however, has been preferred for other flat yarn end-uses, e.g. in taffeta and other closely-woven fabrics because of its lower modulus (of the order of 40 grams per denier), and correspondingly preferred tactile aesthetics. Existing commercial polyester flat (drawn) yarns have a modulus that is too high for such polyester yarns to be preferred over cellulose acetate in such end-uses. Cellulose acetate, however, has inferior tenacity, especially when wet.

For most consumer purposes, a commercial flat yarn should have a low boil-off shrinkage. Hitherto, it has been customary to prepare fabrics with commercial polyester flat yarns of boil-off shrinkage about 8 to 10%, and then reduce the boil-off shrinkage by heat-setting the fabric. Even when existing commercial polyester textile yarns are heat-set, they are not stabilized against shrinkage at temperatures higher than the temperature of heat-setting, because a characteristic of these (drawn) polyester yarns is that the shrinkage increases significantly with increasing temperature. Thus, prior commercial polyester yarns have not been truly thermally dimensionally stable in the same sense, for instance, as a cellulose acetate yarn, whose shrinkage does not increase significantly with temperature. It would be desirable to provide polyester yarns that, after being boiled off, would not shrink significantly, so that heat-setting would be unnecessary to avoid shrinkage during fabric finishing. A low shrinkage tension is also desirable when finishing.

As indicated, some of the properties (such as modulus) of prior polyester yarns have differed according to whether the yarn has been in as-produced condition or has been shrunk, which latter condition is termed herein "after boil-off shrinkage." Properties under both conditions can be important. The yarn manufacturer and textile processor is mainly concerned with the properties in as-produced condition until the yarn is boiled, generally when the fabric is scoured and/or dyed, whereas the ultimate consumer is concerned with the properties of the shrunk fabric, i.e. after boil-off shrinkage. Hitherto, polyester yarns have not been manufactured commercially with properties such that the modulus of the as-produced yarn is of the same order as the modulus of the yarn after boil-off shrinkage.

When dyeing commercial drawn poly(ethylene terephthalate) yarns, dyeing defects result largely from lack of physical uniformity in the yarns. Such defects are more noticeable when dyeing at the boil (i.e. at atmospheric pressure), but use of higher pressures with carriers can give more uniform dyeing. Dyeing defects are readily apparent in taffetas, and other closely woven fabrics, in which flat yarns are used. Uniformity can be of critical importance for apparel yarns. In a customer's opinion, it is probably the most important characteristic. Any polyester replacement for cellulose acetate must dye uniformly, if it is to succeed, and this means that the polyester must show good physical uniformity, as discussed hereinafter.

Thus, it would have been very desirable for certain end-uses to provide poly(ethylene terephthalate) flat yarn with desirable tensile properties, including a suitable lower modulus, a modulus that is not significantly different after boil-off shrinkage, low boil-off shrinkage, thermal stability, and better dyeing properties, but such a combination has not previously been available commercially. It would also be economically desirable to prepare useful continuous filaments for such yarns or tows directly in the as-produced condition, so that flat continuous filament yarns, for example, would need no further processing in the nature of drawing and annealing but could be used directly to prepare fabric.

For many years, polyester filaments were melt spun and withdrawn from the spinneret at relatively low speeds of up to about 1000 meters/minute. These low speed spun undrawn filaments were then subjected to a separate drawing operation, either after winding up the low speed spun filaments in a "split" process, or in a "coupled" continuous operation in which the filaments were first withdrawn at a relatively low speed (less than 1000 meters/minute) and then subjected to drawing without intermediate windup. Hitherto, drawing has been a step in the commercial manufacture of all flat polyester textile yarns.

More recently, polyester filaments have been prepared commercially on a large scale by high speed spinning on windups that are capable of operation at speeds up to about 4000 meters/minute, e.g. as supplied by Barmag Barmer Maschinenfabrik AG, and being described, for instance, in a brochure entitled "SW4S SW4R Spin Draw Machines" and published about June, 1973. The polyester filaments commercially produced at such speeds are referred to as "partially oriented" and have been particularly useful as feed yarns for draw-texturing, as disclosed by Petrille in U.S. Pat. No. 3,771,307. These yarns have not been useful as flat yarns. Their tenacity and modulus have been lower, while their elongation and shrinkage have been higher, than commercial polyester flat yarns; their shrinkage has generally been at least 60%, i.e. much too high for normal textile purposes. The subsequent draw-texturing operation raises the tenacity and modulus and reduces the elongation and shrinkage to the values that have hitherto been considered desirable for polyester textile yarns.

Thus, heretofore, drawing has been a step in all commercial manufacture of polyester textile yarns.

High speed spinning of polyester filaments at speeds of 3000 to 5200 yards per minute was suggested 25 years ago by Hebeler in U.S. Pat. No. 2,604,689, with the objective of providing wool-like yarns of low modulus 10 to 50 grams/denier (110 to 550 kg/mm$^2$). Spinning at even higher speeds, above 5200 yards per minute, was suggested by Hebeler in U.S. Pat. No. 2,604,667 with the statement that lower spinning speeds result in high shrinkage yarn of quite different properties. High speed spinning generally, has received much attention, e.g. by H. Ludewig in Section 5.4.1 of his book "Polyester Fibres, Chemistry & Technology," German Edition 1964 by Akademie Verlag and English translation 1971 by John Wiley & Sons, Ltd., and the effect on shrinkage is discussed in Section 5.4.2. More recently, there has been interest in high speed spinning at speeds much greater than 4000 meters/minute, e.g. as disclosed by F. Fourné in Chemiefasern/Textil-Industrie, Dec. 1976, pages 1098–1102, the emphasis being on providing continuous filament yarns and tows (for staple fiber) by spinning at these much higher speeds, using faster windups, rather than at speeds of the order of 4000 meters/minute, using prior windups. It would be desirable, however, to provide useful continuous polyester filaments, as indicated hereinbefore, using existing commercial windups operating at about 4000 meters/minute, rather than these much greater speeds, because of the cost of developing and operating the latter.

There has also been recent interest in spinning at speeds of about 4,000 meters/minute and in modifying the process conditions to reduce the shrinkage of the resulting filaments. For instance, E. Liska in Chemiefasern/Textil-Industrie, Sept. 1973, pages 818–821, Oct. 1973, pages 964–975 and Nov. 1963, pages 1109–1114, discusses the structural changes in polyester fibers from orientation (obtained by high speed spinning) and annealing, and recommends raising the molecular weight (intrinsic viscosity) and the denier per filament to reduce the shrinkage. Raising the viscosity has also been suggested, e.g. in Japanese Patent Publication No. 49-80322/1974 (Kuraray Company). This is costly and is not desirable for apparel yarns as a cellulose acetate replacement.

So far as is known, it has not previously been suggested that the problem of producing a poly(ethylene terephthalate) flat yarn having an acceptable combination of dyeability (superior to that of commercial (drawn) flat poly(ethylene terephthalate) yarns) and of physical properties, especially tensile properties and thermal dimensional stability, could have been solved by spinning directly poly(ethylene terephthalate) filaments having such superior dyeability and acceptable physical properties, using windups capable of operation at about 4000 meters/minute.

SUMMARY OF THE INVENTION

According to the present invention, there are provided new poly(ethylene terephthalate) continuous filament flat yarns and continuous filament tows comprising continuous filaments of 1 to 7 denier per filament, preferably 1 to 4 denier per filament, and especially 1 to 2 denier per filament, and staple fiber of similar denier, and intrinsic viscosity [$\eta$] 0.56 to 0.68, characterized (1) by a relative disperse dye rate (RDDR) of at least 0.09, preferably at least 0.11 as defined hereinafter, (2) by a modulus (initial modulus) of about 30 to about 65 grams/denier, when measured on the yarn, tow or staple fiber as-produced (M), and after being boiled in water at atmospheric pressure for 60 minutes ($M_2$), and (3) by an amorphous modulus ($M_A$) of about 28 to about 38 grams/denier, preferably less than 36.5 grams/denier, where the amorphous modulus is related to the normalized modulus ($M_n$) according to the expression:

$$M_A = M_n - X,$$

where $$M_n = (0.65/[\eta])^{0.3} M$$

where [$\eta$] is the intrinsic viscosity, and X is a value given by the expression:

$$X = 530(\rho - 1.335)\,(0.65/[\eta])^{0.3}$$

and is between 5 and 25, and where $\rho$ is the density of the poly(ethylene terephthalate);

(4) by (a) a boil-off shrinkage (S) of about 2 to about 6%, preferably about 2 to about 4%, and/or by (b) a shrinkage modulus ($M_S$) of about 1.5 to about 3.5 grams per denier, and (5) by a thermal stability such that the shrinkage value $S_2$ as defined hereinafter is less than 1%.

Preferred yarns and tows also have tenacity 2.0 to 4.0 grams/denier, especially at least 2.5 grams/denier, e.g., 2.5 to 3.5 grams/denier, elongation 40% to 125%, especially 40% to 100%, tenacity at 7% elongation 0.7 to 1.2 grams/denier, birefringence at least 0.045, especially 0.05 to 0.09, crystal size 50 Å to 90 Å and at least 1430

($\rho-1.335$) Å, and density ($\rho$) at least 1.35, especially 1.35 to 1.38. Preferred staple fiber has similar properties.

Preferred bundles of continuous filaments have excellent physical uniformity, e.g. when measured on the same yarn package, as indicated by denier spread (DS) less than about 6%, preferably less than 4%, draw tension variation (DTV) less than about 1.2%, preferably less than 0.8%, and interfilament elongation uniformity (IEU) less than about 12.5% and may be used in textile processing with no significant filament breakage as indicated by a low differential filament birefringence ($\Delta_{95-5}$) of less than $((\Delta/20)+0.0055)$ wherein the birefringence $\Delta$ is 0.045 to 0.09.

These yarns and tows can be manufactured directly by spinning with conventional windups capable of operation at 4000 meters per minute to give continuous filament products of sufficient uniformity to be useful in fabrics.

By "flat yarn" herein is meant an untextured continuous filament yarn. "Untextured" means the filaments show no significant 3-dimensional configuration (e.g., crimp) which could lead to optical configurational dye defects and make the filaments unacceptable for such textile end-uses as taffetas and other closely-woven fabrics. An untextured yarn should show no such significant 3-dimensional configuration even after boiling.

DETAILED DESCRIPTION OF THE INVENTION

Figure 1:
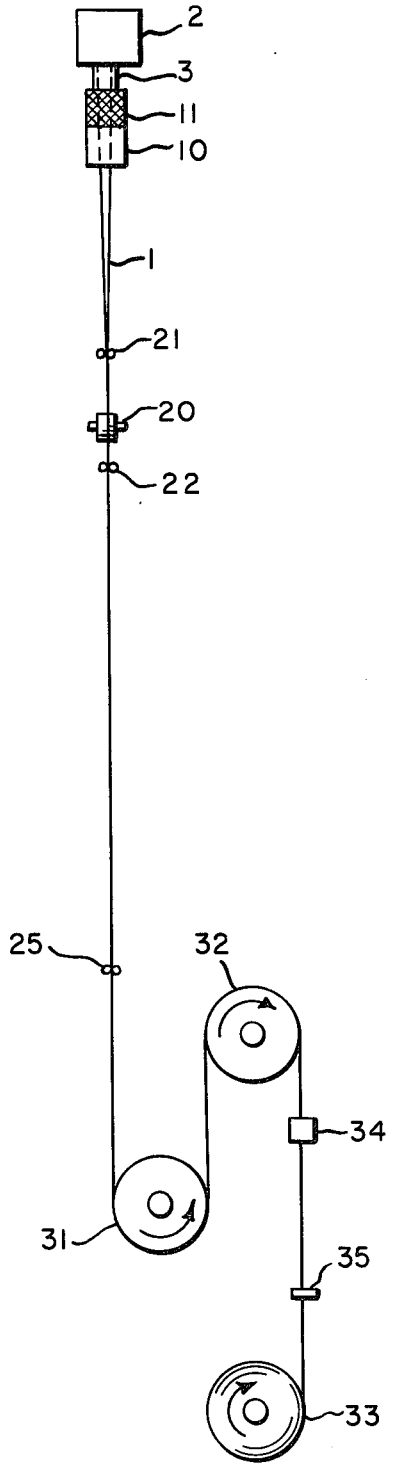
FIG. 1 illustrates schematically a typical process for high speed spinning for use in preparing filaments and yarns according to the present invention.

For convenience, the following measurements are described in relation to a multifilament flat yarn, but may be adapted for continuous filament tows or staple.

The modulus (M) and other tensile properties herein are measured on an Instron Tester TTB using one-inch by one-inch (about 2.5 cm×2.5 cm) flat-faced jaw clamps (Instron Engineering Corporation) with a twister head made by the Alfred Suter Company, using a ten-inch sample length and two turns of twist per inch (about 25 cm length and 8 turns twist per 10 cm) at a 60% per minute rate of extension at 65% relative humidity and 70° F. (21° C.) The modulus (M), often referred to as "initial modulus," is obtained from the slope of the first reasonably straight portion of a load-elongation curve, plotting tension on a y-axis against elongation on the x-axis as the yarn is being elongated at the above rate under the above conditions.

A modulus (M) within the range 30 to 65 grams/denier is desired for tactile aesthetics, i.e. lower values tend to give mushy limp fabrics, whereas higher values give a harsh boardy feel as contrasted with fabrics of cellulose acetate filaments of similar denier. For acetate replacement, a modulus of <50 grams/denier is desirable, so yarns of modulus 40 to 50 grams/denier are preferred for this purpose. Yarns of the invention preferably have a yield tenacity as measured by the tenacity at 7% elongation ($T_7$) of 0.7 to 1.2 grams/denier, which provides sufficient strength for direct wet and dry textile processing so to prevent permanent nonuniform extension (i.e., yielding) which would lead to undesirable dye defects. Preferred yarns of the present invention are stable to boiling water in the sense that the modulus of the as-produced yarn is not more than 5 grams/denier different from the modulus of the shrunk yarn after boil-off (under atmospheric pressure in a relaxed state) i.e. $\Delta M \leqq 5$, where $\Delta M$ is the difference between these modulus values. The modulus measured either on the as-produced yarn or the shrunk yarn (after boil-off) should be between about 30 and about 65 grams/denier. However, as indicated above and hereinafter in Table 1, the modulus of commercial (drawn) polyester flat yarn is lowered significantly by being boiled at atmospheric pressure in a relaxed state. The "Modulus" of the yarns and tows of the invention referred to herein is generally measured on the yarn as-produced, whereas the modulus after boil-off is referred to as "$M_2$."

The amorphous modulus ($M_A$) correlates with amorphous orientation, and is calculated, as indicated, using a normalized value of M (modulus of as-produced yarn)

$$M_n=(0.65/[\eta])^{0.3}M,$$

from which is subtracted a normalized crystallinity factor or "X value"

$$[530(\rho-1.335)(0.65/[\eta])^{0.3}],$$

which is between 5 and 25. The range of 28 to 38 grams/denier for the amorphous modulus ($M_A$) provides suitable tactile aesthetics, similar to those of cellulose acetate filaments of similar denier. A low amorphous modulus is one of the factors related to improved dyeability (as measured by RDDR). Preferred yarns have a relatively low amorphous modulus within this range, preferably less than 36.5, especially less than 35 grams/denier. As the amorphous modulus is still further reduced, however, increasingly stringent conditions of filament preparation generally become necessary to ensure that the shrinkage and thermal stability are such as to provide filaments that will make useful flat yarns for the intended end-use, in contrast to the less stringent conditions needed, in general, to attain the desired low shrinkage and good thermal stability for filaments of higher amorphous modulus (but accompanied generally by reduced dyeability). As the amorphous modulus is increased, the shrinkage tension also tends to increase.

The shrinkage values herein are generally boiloff shrinkages (S) and are measured by suspending a weight from a length of yarn to produce a 0.1 gram/denier load on the yarn and measuring its length ($L_o$). The weight is then removed and the yarn is immersed in boiling water for 30 minutes. The yarn is then removed, loaded again with the same weight, and its new length recorded ($L_f$). The percent shrinkage (S) is calculated by using the formula:

$$\text{Shrinkage } (\%)=100\,(L_o-L_f)/L_o$$

A low shrinkage is highly desirable for most textile purposes. The yarns of this invention can be prepared with suitably low shrinkage directly, i.e. in the as-produced condition, in contrast to prior commercial textile polyester yarns that have all been drawn and annealed, thus reducing their shrinkage. The lower the shrinkage, the less then physical properties of the yarn, e.g. the modulus, tend to be affected by boiling in a relaxed state, extremely low shrinkage values, however, being increasingly difficult to obtain directly, e.g. less than about 2%. As-produced yarns of this invention having low shrinkage are prepared without the need for extremely high spinning speeds of 6,000 meters/minute.

The Dry Heat Shrinkage (DHS) is given only in Table 1, and is measured by following essentially the same procedure as for measuring boil-off shrinkage except that the yarn is subjected to dry heating for 30 minutes at 180° C., instead of being immersed in boiling water.

The thermal stability ($S_2$) is measured by taking a shrunk yarn that has been subjected to the boil-off shrinkage test and measuring any dry heat shrinkage of such shrunk yarn essentially following the procedure for measuring dry heat shrinkage at 180° C. Under these test conditions, some yarns may elongate, in which case the $S_2$ is given in parentheses with an E, e.g. the $S_2$ value for the yarn of Example 2 is (0.2E), showing the yarn elongated by only 0.2%. $S_2$ is preferably less than 1%, since it is desirable that, after boiling, the yarns should not shrink significantly. It is also desirable that the yarns not elongate too much, e.g. not more than 3%, and preferably not more than 2%.

The shrinkage tension is measured, using a shrinkage tension-temperature spectrometer (The Industrial Electronic Co.) equipped with a Statham Load Cell (Model UL4-0.5) and a Statham Universal Transducing CEU Model UC3 (Gold Cell), on a 10 cm loop of yarn, mounted at a fixed length under an initial load of 0.005 grams/denier, at about 30° C., and with the temperature being raised in an oven at 30° C. per minute. The maximum value for the shrinkage tension is herein denoted as ST. A low maximum shrinkage tension is desirable for most fabric finishing. Yarns of the invention generally have lower maximum shrinkage tensions than do prior commercial textile polyester yarns, because the latter have been drawn as some stage during their preparation. The maximum shrinkage tension of the yarns of the invention is typically less than about 0.15 grams/denier. A low maximum shrinkage tension is generally more difficult to attain with very low denier filaments. The shrinkage modulus ($M_S$) is obtained by dividing the maximum shrinkage tension (ST) by the shrinkage (S) and multiplying by 100, i.e. $M_S=(ST/S\times 100$. A shrinkage modulus of between 1.5 and 3.5 grams/denier represents a desirable balance between shrinkage tension and shrinkage.

The intrinsic viscosity [$\eta$] is a measure of the molecular weight, and is given by $[\eta]=\text{limit } (\ln\eta_r/C)$ as C approaches zero, wherein $\eta_r$ is the viscosity of a dilute solution of the polyester in hexafluoroisopropanol containing 100 ppm $H_2SO_4$, divided by the viscosity of the $H_2SO_4$-containing hexafluoroisopropanol solvent itself, both measured at 25° C. in a capillary viscometer and expressed in the same units, and C is the concentration in grams of the polyester in 100 ml of the solution. An intrinsic viscosity of about 0.65 is generally preferred for poly(ethylene terephthalate) textile filaments. A significantly higher viscosity, e.g. above 0.68, is not preferred for textile applications and for economic reasons. Thus a polymer viscosity of 0.66 or less is generally preferred. A value of at least 0.56 is preferred since, as the viscosity is further reduced, it generally becomes more difficult to obtain filaments having the desired low shrinkage using conventional windups of the type described.

The density of a filament may be measured as in ASTM D1505-63T, and should be corrected for any additives, e.g. for $TiO_2$ content, to give the density of the poly(ethylene terephthalate) ($\rho$), which is a convenient measure of crystallinity. The correction used herein has been to subtract ($0.0087\times$% $TiO_2$) from the measured density of the filament to get the density of the poly(ethylene terephthalate) ($\rho$), which latter has been reported in the Examples. A high crystallinity, i.e. a high density, corresponds to low shrinkage, which is desired. Yarns according to this invention preferably have a density ($\rho$) of at least 1.35 and generally up to about 1.38 grams/cm$^3$. These densities are higher than for as-spun yarns prepared by low speed spinning or for commercial partially-oriented yarns prepared by high speed spinning (3000 to 4000 meters/minute). The crystallinity of such prior commercial as-produced yarns has been raised to desirable values for textile purposes by drawing and annealing, which is not desirable according to the present invention since it can reduce dyeability.

The crystal size (CS) is estimated from the Scherrer formula $CS=K\lambda/\beta\cos\theta$ where K is taken to be unity; $\lambda$ is 1.5418 Å, the wavelength of $CuK_\alpha$ X-rays; $\theta$ is the Bragg angle of diffraction; $\beta$ is line broadening corrected for instrumental broadening by $\beta^2=B^2-b^2$ where B is the observed broadening and b is the instrumental broadening as measured on a ZnO pattern assuming infinitely large crystallites (all angle measurements in radians). B is measured on a photographic film pattern of a sample using the diffraction arc at $2\theta=17.5°$ (the 010 diffraction), and is measured radially along the equator, i.e. at its maximum intensity, by the techniques described by H. P. Klug and L. E. Alexander in "X-ray Diffraction Procedures," John Wiley and Sons, Inc. New York (1954), Chapter 9.

The filaments of this invention preferably have crystal sizes that are related to the fiber density by the relation $CS\geqq 1430(\rho-1.335)$ Å, and are preferably greater than about 50 Å, especially greater than 60 Å. Generally, the larger the crystal size, the better the tensile properties, about 90 Å being a maximum that is likely to be attainable in practice. Drawing techniques lead to smaller crystal sizes than are given by the relationship $CS\geqq 1430(\rho-1.335)$ Å, because they are crystallized in other textile processes, e.g., coupled spin/drawing and draw-set-texturing. The relatively large crystal size at a modest density value is an important characteristic of filaments of the invention, and is considered responsible for the thermal stability and partly responsible for the improved dyeability of the filaments of the invention in contrast to prior commercial polyester filaments.

Birefringence ($\Delta$) is a measure of the orientation of the polymer chain segments. Birefringence may be measured by the retardation technique described in "Fibers from Synthetic Polymers" by Rowland Hill (Elsevier Publishing Co., New York, 1953) pages 266–268, wherein the birefringence is calculated by dividing the measured retardation by the measured thickness of the structure, expressed in the same units as the retardation; or by the interference fringe technique (to be described below) which is preferred for non-round cross-section filaments and for filaments having high orders of retardation. The value reported is the mean for 10 filaments measured near the center of each filament (plus or minus 5% away from the filament axis). The birefringence of the filaments of the invention is modest (compared with prior art drawn filaments) despite their suitability for use in textile processing without drawing. Preferred values are at least 0.045, which distinguishes from filaments spun at lower speeds, to not more than about 0.09, which distinguishes from highly oriented yarns prepared by drawing or by spinning at higher speeds. A particularly preferred range of birefringence is 0.05 to 0.09.

For continuous filament yarns and tows to undergo textile processing without significant filament breaks, it is important that the filaments have a low differential birefringence ($\Delta_{95-5}$). This desideratum is referred to herein as low "skin-core" in the sense that it is important to minimize any "skin" on the surface of the filament, such skin being detectable by a large difference between the birefringence near the surface and that near the center of the filament, i.e. it is important to minimize this difference. It becomes more difficult, in practice, to achieve this as the average birefringence value within the filament near its center (±5%) increases. Differential birefringence ($\Delta_{95-5}$) is defined herein as the difference between the chord average birefringence near the surface of a filament ($\Delta_{95}$) and the chord average birefringence within the filament near its center ($\Delta_5$).

A double-beam interference microscope, such as is manufactured by E. Leitz, Wetzlar, A. G., is used. The filament to be tested is immersed in an inert liquid of refractive index $n_L$ differing from that of the filament by an amount which produces a maximum displacement of the interference fringes of 0.2 to 0.5 of the distance between adjacent undisplaced fringes. The value of $n_L$ is determined with an Abbe refractometer calibrated for sodium D light (for measurements herein it is not corrected for the mercury green light used in the interferometer). The filament is placed in the liquid so that only one of the double beams passes through the filament. The filament is arranged with its axis perpendicular to the undisplaced fringes and to the optical axis of the microscope. The pattern of interference fringes is recorded on T-410 Polaroid film at a magnification of 1000×. Fringe displacements are related to refractive indices and to filament thicknesses, according to the equation:

$$d/D=(n-n_L)t/\lambda$$

where n is the refractive index of the filament,

λ is the wavelength of the light used (0.546 micron), d is the fringe displacement, D is the distance between undisplaced adjacent fringes, t is the path length of light (i.e., filament thickness) at the point where d is measured. For each fringe displacement, d, measured on the film, a single n and t set applies. In order to solve for the two unknowns, the measurements are made in two liquids, preferably one with higher and one with lower refractive index than the filament according to criteria given above. Thus, for every point across the width of the filament, two sets of data are obtained from which n and t are then calculated.

This procedure is carried out first using polarized light having the electric vector perpendicular to the filament axis, at measuring points 0.05, 0.15, . . . , 0.85, 0.95 of the distance from the center of the filament image to the edge of the filament image. This procedure yields the chord average n⊥ refractive index distribution. The n || refractive index distribution is obtained from one additional interference micrograph with the light electric vector polarized parallel to the filament axis (using an appropriate immersion liquid preferably having a refractive index slightly higher than that of the filament). The t (path length) distribution determination in the n⊥ measurement is used for the n || determination.

Birefringence (Δ), by definition is the difference (n || −n⊥). Differential birefringence ($\Delta_{95-5}$) is then the difference between Δ at the 0.95 point and the 0.05 point on the same side of the filament image. The value of $\Delta_{95-5}$ for a filament is the mean of the two $\Delta_{95-5}$ values obtained on opposite sides of the filament image.

In all of the above calculations, all linear dimensions are in the same units and are converted, where necessary, either to the magnified units of the photograph or to the absolute units of the filament.

This procedure is intended to be applied to filaments having round cross sections. It can also be applied to filaments having other cross sections by changing only the definition of the averaging procedure to obtain $\Delta_{95-5}$. The "skin" indicated above amounts to about 10% of the fiber volume. In applying this to a non-round fiber the portion defined as skin should also include the outer 10% of the fiber, but there must be sufficient averaging with respect to different positions in the fiber skin, effected by rotating the fiber about its axis to various angles, to ensure that the skin birefringence value is truly representative.

The preferred filaments of these yarns and tows have $\Delta_{95-5}$ values less than $\Delta_{95-5} \leqq \Delta/20+0.0055$. For this purpose, Δ is preferrably measured by the interference fringe technique.

The dyeability of various yarns is compared herein by measuring their disperse dye rate, DDR, which is defined hereby as the initial slope of a plot of percent dye in filament by weight versus the square root of dyeing time, and is a measure of a dye diffusion coefficient (if corrected for difference in surface to volume ratio). The values of the disperse dye rate are normalized to a round filament of 2.25 denier per filament having a density of 1.335 grams/cm$^3$, i.e. of an amorphous 70–34 round filament yarn after being boiled, as a relative disperse dye rate, RDDR, defined by the relation:

$$RDDR = DDR \text{ measured } [(dpf/2.25)(1.335/\rho)(100/100-S)]^{\frac{1}{2}}$$

where ρ is the polymer density, dpf is the filament denier, and S is the boil-off shrinkage. The RDDR value is more or less independent of the surface-to-volume ratio of the dyed filaments, and reflects differences in filamentary structure affecting dye diffusion.

The disperse dye rates are measured using "Latyl" Yellow 3G (CI 47020) at 212° F. for 9, 16 and 25 minutes using a 1000 to 1 bath to fiber ratio and 4% owf (on weight of fiber) of pure dyestuff. The dyestuff is dispersed in distilled water using 1 gram of "Avitone T" (a sodium hydrocarbon sulfonate) per liter of dye solution. Approximately 0.1 gram yarn sample is dyed for each interval of time; quenched in cold distilled water at the end of the dyeing cycle; rinsed in cold acetone to remove surface-held dye; air-dried and then weighed to four decimal places. The dyestuff is extracted repeatedly with hot monochlorobenzene. The dye extract solution is then cooled to room temperature (~70° F.) and diluted to 100 ml with monochlorobenzene. The absorbance of the diluted dye extract solution is measured spectrophotometrically using a Beckmann model DU spectrophotometer and 1 cm corex cells at 449μ. The % dye is calculated by the relation:

$$\% \text{ dye} = \left(\frac{\text{absorbance}}{\text{sample wt. (gms)}}\right)\cdot\left(\frac{\text{dye molecular wt.}}{\text{extinction coefficient}}\right)\cdot\left(\frac{\text{volume of diluted dye extract solution (ml)}}{1000}\right)\cdot 100$$

The ratio of the dye molecular weight and (molar) extinction coefficient is 0.00693 gm. The DDR is the slope of these plots of % dye (by weight) versus square root of dyeing time (min)$^{\frac{1}{2}}$ measured at 9, 16 and 25 minutes.

Commercial poly(ethylene terephthalate) textile yarns (i.e. drawn yarns) have RDDR values of about 0.05 and may require up to 5g/l of carriers to dye-at-the-boil, whereas yarns of this invention have RDDR values greater than 0.09 and typically above 0.11. Although it may be desirable to use leveling agents and/or small amounts of carrier in practice when dyeing yarns of this invention, especially at lower temperatures than the boil, such yarns do have a capability of being dyed to deep shades by disperse dyes without a carrier in a normal dye cycle.

Preferred continuous filament yarns and tows are also characterized by excellent along-end uniformity, as measured by along-end denier spread and draw tension coefficient of variation, and excellent filament-to-filament uniformity, as measured by elongation uniformity, which properties provide uniform dyeing of the yarns and tows.

Denier spread is measured on a Model C Uster evenness tester, manufactured by Zwellweger-Uster Corporation. Reported values are the average range of linear irregularity of the mass of the yarn, expressed as percent denier spread (DS). The mathematic definition of % DS is given below:

$$\% DS = \frac{\text{(max. denier} - \text{min. denier)}}{\text{average denier}} \times 100$$

where reported % DS are averages of five determinations on 100-yard length samples measured with the following machine settings:

Twist—1 "Z" TPI
Speed—100 yards per minute of yarn
Machine sensitivity—half inert test
Evaluating time—1 minute
Operating tension—7 grams between tension brake and twisting head.

Preferred filament yarns and tows have % DS less than 6% and especially less than 4%.

The variation of draw tension (DT) along the length of a continuous filament yarn or tow is a measure of the along-end orientation uniformity and relates to dye uniformity. Yarns having high draw tension variation (DTV) give nonuniform streaky dyed fabrics. It is desirable to have low DTV values for uniform dyeing.

The draw tension is measured with a Statham® UC-3 transducer equipped with a UL-4 load cell adapter on a yarn or tow drawn to a draw ratio equal to:

$$\frac{\text{Elongation-to-break (\%)} + 60\%}{100\%}$$

while passing at an output speed of 100 yards per minute through a 36-inch tube heated to 200° C. The average draw tension ($\bar{X}$) is based on 10 ten-second intervals. The draw tension variation (DTV) is defined as the ratio of the standard deviation ($\sigma$) of these ten readings to average draw tension ($\bar{X}$) multiplied by 100:

$$DTV\,(\%) = (\sigma/\bar{X})\cdot 100.$$

Preferred filament yarns and tows have DTV values less than 1.2% and especially less than 0.8%.

Interfilament Elongation Uniformity (IEU), i.e. the filament-to-filament uniformity of break elongation in a length of a multi-filament bundle (yarn or tow), is a measure of the interfilament uniformity of molecular orientation, which in turn reflects spinning process symmetry and uniformity, in particular with respect to quench, attenuation and snubbing. A convenient way to quantify IEU is to differentiate the force versus elongation relationship of a zero twist yarn bundle throughout the region where filaments are breaking.

Differentiating the load cell amplifier signal from a conventional Instron® tensile tester will transform the continuously decreasing force versus time relationship corresponding with breaking filaments into a peak characterized by a height (H) and a width (W) at half peak height. IEU is defined as the ratio of the width (W) at half height of the filament breaking peak to the break elongation (E), where E and W are measured in the same units.

Figure 3:
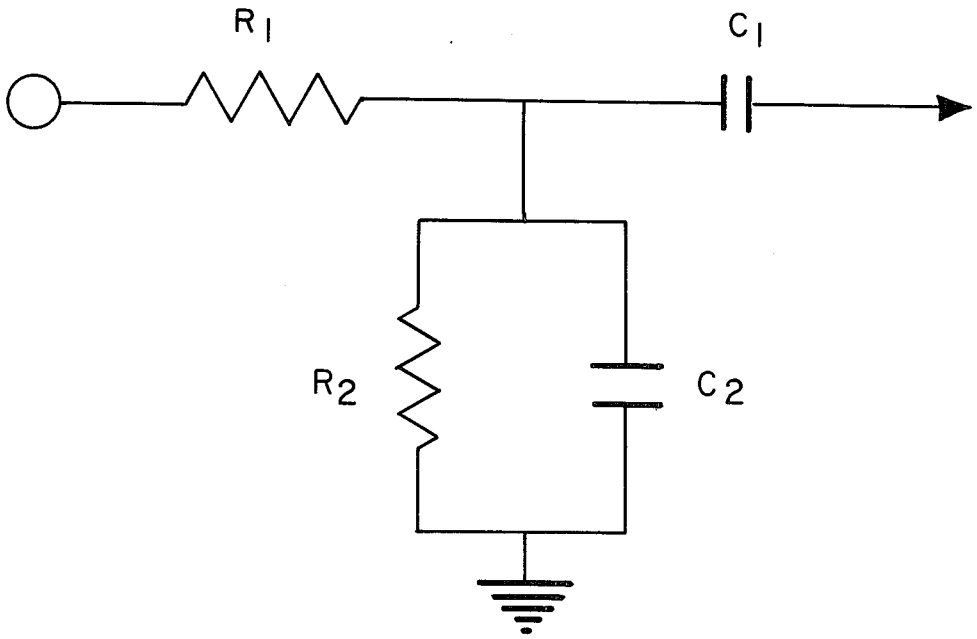
FIG. 3 is a circuit that is used in connection with a uniformity test (IEU) for continuous filament yarns.

The differentation of load cell amplifier signal from a conventional Instron® tensile tester was performed using the resister/capacitor (R/C) circuit schematically represented in FIG. 3 wherein the symbols "O" denotes input signal from Instron® tensile tester load cell amplifier; "→" denotes output signal to a Fisher Recordall® Series No. 5000 strip chart recorder (0.1 volt full scale); and "⏚" denotes the ground terminal and wherein $R_1 = 100{,}000$ ohm resistor, $R_2 = 10{,}000$ ohm resistor, $C_1 = 1.5\mu$ farad capacitor, and $C_2 = 2.0\mu$ farad capacitor. Because of the time constants in this equipment it is important that the cross head speed (HS) and the initial sample length ($L_s$) be adjusted so that the filament strain rate at the break point is approximately constant for all samples being compared. For this work sample lengths ($L_s$) were in the range of 6 to 8 inches (corresponding to about 15 to 20 cm) and cross head speeds (HS) were adjusted so that the break elongation (E) would be reached after 0.3 to 0.4 minutes. This condition is fulfilled by the relation $$30 \leqq (L_s/HS)E \leqq 40$$

$L_s$ is the intial sample length, HS is the Instron® tensile tester cross head speed in inches per minute (or correspondingly cm/minute) and E is breaking elongation (%).

Ideally, a perfect multifilament bundle or a monofil would have an IEU value of zero. Due to time constants associated with the differentiating and recording equipment used in this work, the IEU of a monofil was 7.5%. The IEU value tends to be greater than 7.5% for large filament bundles. Preferred multifilament yarns and tows have IEU values below, i.e., better than 12.5%.

Filaments having the desired properties may be spun using windup speeds within the approximate range 3400 to 4600 meters/minute, and preferably about 4000 meters/minute, as shown hereinafter in the Examples wherein poly(ethylene terephthalate) is extruded, at a flow rate to give the desired dpf, through capillaries of dimensions selected such that the polymer temperature and melt viscosity at the orifice are controlled, into an inert gaseous atmosphere (preferably air) where the rate of heat dissipation from the freshly-extruded filaments is controlled during attenuation by adjusting the air flow pattern just below the spinneret and the air flow rate, direction, and temperature. It will be understood that a significant change in any of the above factors, or in other factors such as windup speed, spinning temperature, pressure exerted on the melt, filament bundle or configuration, or polymer viscosity, will require a compensating change in another factor. Thus, it is possible to prepare the desired filaments having a useful combination of physical properties and dyeability, such as make them applicable for use as flat continuous filament yarns or for conversion into staple fiber, by directly spinning such continuous filaments using conventional commercial windups capable of operation at speeds of about 4000 meters/minute, and without drawing or annealing, which would increase the amorphous orientation and the crystallinity, without, however, comparably increasing the crystal size in relation to the density according to the foregoing relationship $CS \geqq 1430 (\rho - 1.335)$ Å, and so would reduce the dyeability, and are therefore not desirable process steps.

The terms *spinning speed* and *withdrawal speed* have been used herein to refer to the speed of the first driven roll wrapped (at least partially) by the filaments. The term spinning speed is used more frequently in the art, and is essentially the windup speed (i.e. the speed at which the filaments are wound on a package) in the spinning stage of a split process or in a high-speed spinning process. In a coupled spin-draw process, the windup speed is significantly faster than the spinning speed, and so the term withdrawal speed has sometimes been referred to, so as to avoid confusion with the windup speed; a process in which the filaments are withdrawn from the spinneret at a speed much lower than the windup speed and space-drawn without the use of feed rolls to control the withdrawal speed and draw ratio, is such a "coupled" spin-draw process; these processes are not desirable.

Referring to FIG. 1, showing a typical high speed spinning apparatus for use in preparing yarn according to the invention, molten polyester is melt spun through orifices in a heated spinneret block 2 and cooled in the atmosphere to solidify as filaments 1. As the molten polyester emerges from block 2, it is preferably protected from the atmosphere by a metal tube 3 (insulated from the face of the spinneret and block by a gasket) surrounding the filaments as they pass between the orifices and a zone 10 in which cooling air is introduced, preferably symmetrically around the filaments through the holes in a foraminous metal tube 11, essentially as described in Dauchert U.S. Pat. No. 3,067,458. The filaments may optionally pass between convergence guides 21, which are arranged so as to confine the filaments, and then in contact with rolls 20 which rotate in a bath of spin-finish and thus apply the desired amount of finish to the solid filaments, and then pass another set of guides 22 which hold the filaments in contact with the finish roll 20 and direct the filaments to the next set of guides 25, and on to the windup system, which comprises a first driven roll 31, a second driven roll 32, a traversing guide 35 and a driven take up roll 33, the yarn being interlaced by an interlacing jet 34.

Figure 2:
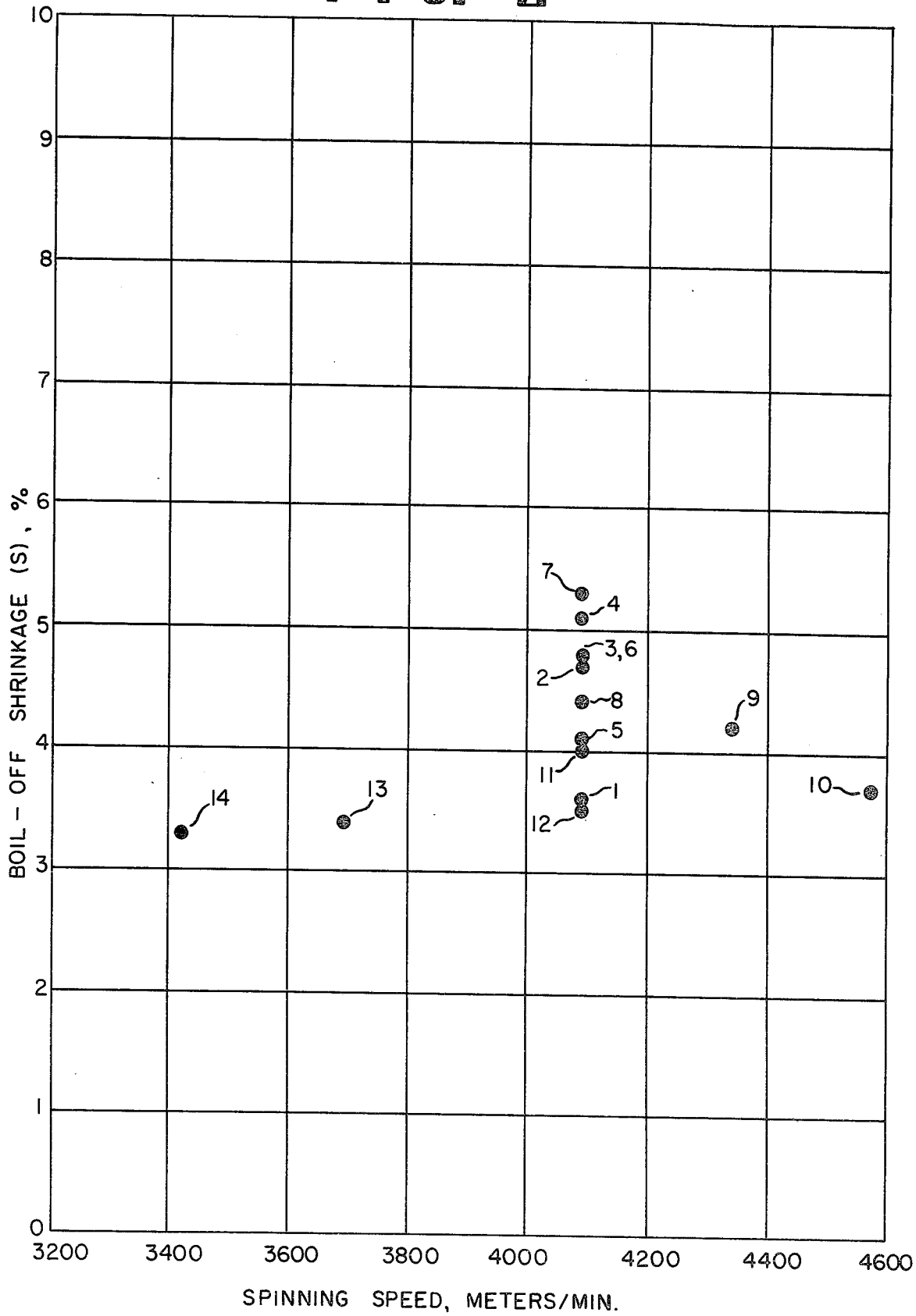
FIG. 2 is a graph plotting the boil-off shrinkage (S) of the poly(ethylene terephthalate) yarns and tows of the Examples on the v-axis against the spinning speed in meters/minute used to produce such yarns and tows on the x-axis.

The invention is further described in the following Examples. The properties and conditions of preparation are presented in summary form in Table 2 at the end of the description. The percentages of titanium dioxide are by weight, calculated on the total weight. The birefringence was not measured for each sample, but is believed to be between 0.05 and 0.09 for all Examples. FIG. 2 shows the boil-off shrinkage values for the yarns and tows of the Examples plotted against the spinning speed. Prior art polyester spun at the same speeds resulted in yarns of higher shrinkage, which higher shrinkage was usually later reduced by a drawing/annealing process, which is not desirable for producing dyeable thermally-stable yarns of the present invention.

EXAMPLE 1

Poly(ethylene terephthalate) of intrinsic viscosity 0.66 is spun on apparatus essentially as described above and illustrated in FIG. 1 to form a 68 filament flat yarn of 1.02 denier per filament (round cross-section) at a windup speed of 4500 yards/minute (4115 meters/minute), using a spinneret block at 298° C. and a pack pressure of 3500 psig through spinneret capillaries of diameter (D) 9 mils and of length (L) 50 mils, the emerging filaments being protected by a hollow tube of length about 2 inches and then subjected to a radially-inwardly-directed flow of air at room temperature at a rate of 25 standard cubic feet per minute (SCFM). The solidified yarn contacts a finish roll, the finish being as described in Example 1 of Burks and Cooke U.S. Pat. No. 3,859,122, and the yarn is interlaced and wound up, without any drawing step. It will be noted that the dyeability is good (RDDR of 0.1), the amorphous modulus ($M_A$) being 32.4 grams/denier, the modulus (M) is 51.4 grams/denier and the boil-off shrinkage is only 3.6%. The thermal stability is excellent as shown by a dry heat shrinkage after boil-off ($S_2$) of only 0.3%. The modulus after boil-off ($M_2$) is 54.5 grams/denier, so the difference $\Delta M$ between M and $M_2$ is only about 3 grams/denier. The X value (difference $M_n - M_A$) is about 19 grams/denier, i.e. between 5 and 25. The shrinkage modulus ($M_S$) is 3.22 grams/denier. The crystal size (CS) is 71 and the density of the polymer ($\rho$) is 1.3707, so $CS > 1430(\rho - 1.335)$, i.e. $CS > 50$. The birefringence ($\Delta$) is 0.0883.

EXAMPLE 2

A 68 filament flat yarn of 1.52 denier per filament and good dyeability and other properties was spun as in Example 1, except that the polymer was of intrinsic viscosity 0.65, the block temperature was 296° C., the pack pressure 4900 psig, and the emerging filaments were protected by a hollow tube of length about 4 inches and were cooled with 50 standard cubic feet per minute of air. The shrinkage is 4.7%, and the thermal stability is excellent ($S_2$ is 0.2 elongation).

EXAMPLE 3

A 40 filament flat yarn of 1.92 denier per filament and good properties was spun from polymer of intrinsic viscosity 0.65 essentially as in Example 1, but with a block temperature of 295° C., pack pressure of 3800 psig, and spinneret capillaries of diameter 12 mils and length 17 mils, the emerging filaments being cooled by cross-flow air in amount 41 standard cubic feet per minute over a distance extending 30 inches below the spinneret. The polymer contained 0.3% by weight of titanium dioxide pigment.

Some of the properties of the flat polyester yarn of Example 3 are compared with those of prior art drawn polyester yarn (control) and with those of prior art cellulose acetate yarn in Table 1 to show that many of the properties of the polyester yarn of the invention (Example 3) are closer to those of cellulose acetate, rather than the conventional (i.e. prior art) polyester, for instance the shrinkage (S), thermal stability ($S_2$), modulus and elongation. On the other hand, the polyester yarns have superior tenacity, and, importantly, their tenacity is not reduced on wetting, in contrast to cellulose acetate. The yarn of Example 3 has a RDDR some 2 to 3 times that of the conventional polyester, and is capable of being dyed at the boil at a reasonable rate without any carrier using commercially-available atmospheric dyeing equipment conventionally used for cellulose acetate, in contrast to the conventional polyester, which dyes much more slowly and which is dyed, in practice, using high pressure equipment. Cellulose acetate is much easier to dye than either of these polyester yarns, being dyeable at about 70° C. The modulus of the conventional polyester is reduced almost 50% when the yarn is boiled, whereas the modulus of the yarn of Example 3 is substantially the same before and after boiling. The large shrinkage of the conventional polyester is a significant economic disadvantage in fabric processing and the lack of thermal stability (high $S_2$) can be a source of customer dissatisfaction. The shrinkage tension of the yarn of Example 3 is much lower than that of the conventional polyester, and this is important in fabric finishing.

TABLE 1

| | POLYESTERS | | |
|---|---|---|---|
| | Control | Ex. 3 | Cellulose Acetate |
| Denier-No. fils. | 70–34 | 75–40 | 100–40 |
| Specific Gravity | 1.38 | 1.36 | 1.3–1.35 |
| S% | 8–9 | 4.8 | 2.5–3.0 |
| $DHS_{,180° C.}$, % | 15 | 4.5 | (2–3*) |
| $S_2$ % | 5 | (0.2E) | — |
| ST g/d | 0.2–0.5 | 0.09 | — |
| Modulus, g/d | 90–120 | 45 | 30–45 |
| $M_2$, g/d | 50–65 | 45 | — |
| Elongation, % | 25–40 | 87.5 | 23–30 |
| Tenacity, g/d | 3.6–4.6 | 2.84 | 1.2–1.5 |
| Tenacity Loss (wet), % | 0 | 0 | 35–40 |

*Note - cellulose acetate glazes at about 120°C.

EXAMPLE 4

A 34 filament flat yarn containing no titanium dioxide and of 3.20 denier per filament and similar good properties was spun more or less as in Example 3, but using two spinnerets each providing 17 filaments and cooled by cross-flow air in amount 31 standard cubic feet per minute for each bundle, the block temperature being 292° C., pack pressure 4500 psig and the polymer being spun through spinneret capillaries of diameter 10 mils and length 40 mils.

EXAMPLE 5

A 34 filament flat yarn containing 0.2% of titanium dioxide and of 1.49 denier per filament was spun essentially as in Example 3, except that the filaments were of trilobal cross-section and modification ratio 1.75 as described in Holland U.S. Pat. No. 2,939,201, an axially-bored plug was inserted in the counterbore of the spinneret as described in Hawkins U.S. Pat. No. 3,859,031, the restrictions in the bore of the plug-insert were of the capillary dimensions used in Example 1, the block temperature was 302° C., the pack pressure 2200 psig, and air-flow was 44 standard cubic feet per minute, and a different finish was used. The properties of the yarn were good, as shown in Table 2.

EXAMPLE 6

A 34 filament flat yarn of 3.88 denier per filament was spun essentially as in Example 3, except that the filaments were of octalobal cross-section and modification ratio 1.2, as described in McKay U.S. Pat. No. 3,846,969 and a metering plate was used, as described in Cobb U.S. Pat. No. 3,095,607, with capillaries of diameter 15 mils and length 72 mils, above a bottom plate containing orifices of appropriate design for the octalobal filaments, and the block temperature was 296° C., the pack pressure was 3700 psig, the air-flow was 31 standard cubic feet per minute and the polymer contained no titanium dioxide.

In Example 7 polymer of lower viscosity is used, so it will be noted that the normalized modulus ($M_n$) is higher than the modulus (M), but the amorphous modulus and dyeability of the yarn is similar to that in the other Examples.

EXAMPLE 7

A 34 filament flat yarn was spun essentially as in Example 4, but with polymer of lower intrinsic viscosity (0.59) and with 0.9% of titanium dioxide pigment, using a block temperature of 290° C., a pack pressure of 1100 psig, spinneret capillaries of diameter 20 mils and length 80 mils, 19 standard cubic feet per minute per bundle of cross-flow air, and a different finish, to give filaments of 2.16 denier.

EXAMPLE 8

A 40 filament flat yarn of 1.84 denier per filament and good properties was spun as in Example 3, except that the intrinsic viscosity of the polymer was higher (0.67), the block temperature was 298° C., the pack pressure was 3200 psig, the spinneret capillaries were as in Example 4, and 31 standard cubic feet of air per minute were used.

EXAMPLE 9

A 40 filament flat yarn was spun at 4750 yards/minute (4343 meters/minute) from polymer of intrinsic viscosity 0.65, using a block temperature of 302° C., but otherwise essentially as in Example 8, to give filaments of denier 1.86, and useful properties as shown in Table 2. The dyeability is not so good as that of the round yarns of similar denier and lower amorphous modulus, spun at lower speeds.

EXAMPLE 10

An 80 filament flat yarn of 1.88 denier per filament was spun at 5000 yards/minute (4572 meters/minute) but otherwise essentially as in Example 3, except that the pack pressure was 4200 psig, the properties being shown in Table 2.

EXAMPLE 11

An 80 filament flat yarn of 1.86 denier per filament was spun at 4500 yards/minute (4115 meters/minute)

from polymer of intrinsic viscosity 0.65 with 0.3% titanium dioxide using a spinneret block at 290° C. and a pack pressure of 3400 psig through spinneret capillaries of diameter (D) 15 mils and of length (L) 60 mils, but otherwise essentially as in Example 1, except that the air flow was 17.5 standard cubic feet per minute per bundle and a different finish was used. The properties are shown in Table 2. The tenacity is very good at 3.71 grams/denier.

EXAMPLE 12

A 40 filament flat yarn of 1.83 denier per filament was spun as in Example 3, except that the poly(ethylene terephthalate) was made from ethylene glycol, terephthalic acid and 2-ethyl-2-(hydroxymethyl)-1,3-propanediol in amount 0.001146 moles per mole of terephthalic acid), the block temperature was 293° C., the pack pressure was 7200 psig, and the emerging filaments were cooled by cross-flow air in amount of 37.5 standard cubic feet per minute over a distance extending 54 inches below the spinneret.

The tenacity and birefringence are lower, while the elongation is higher and the yarn shows better dyeability, as compared with the yarn of Example 3. The tenacity of 2.14 grams/denier is, however, higher than that of acetate.

The along-end and filament-to-filament uniformity of these flat filament yarns are shown in Table 3. Yarns of Examples 1–4 and 11 are preferred for the preparation of fabric constructions requiring especially good dye uniformity, such as taffetas and other closely woven fabrics. Ex. 6 has acceptable uniformity but a slightly higher differential birefringence Δ95-5 than desired for good textile processability. The other filament yarns and twos should be acceptable for textile and home furnishing end-uses where dye uniformity requirements are not too critical as in a taffeta, for example.

These flat yarns are direct-use yarns, i.e. they may be used in textile fabrics without drawing and annealing, or heat-setting, in contrast to existing commercial partially-oriented yarns which have been draw-textured before use in fabrics. These flat yarns have a useful combination of dyeability and physical properties, including thermal stability, shrinkage, shrinkage tension, and modulus before and after shrinkage, that is significantly different from existing commercial polyester flat yarns, as-produced.

Modifications of the flat yarns may be carried out depending on the desired end-use. The yarns of the present invention have responded favorably to air-jet texturing to provide loopy yarns while retaining good dyeability. On the other hand, if drawing is performed as a part of any texturing operation, then the dyeability is reduced. The yarns may, if desired, be crimped mechanically, e.g. by knit-deknit, gear crimping, stuffer-box or other methods.

The foregoing Examples show the preparation of continuous filament flat yarns. Continuous filament tows may be prepared by combining together bundles of continuous filaments prepared without interlacing, but otherwise substantially as described for the manufacture of flat yarns in the foregoing Examples, or by preparing continuous filament tows using other standard techniques, and staple fiber may be prepared therefrom.

EXAMPLE 13

Several 34 filament continuous filament bundles of poly(ethylene terephthalate) filaments were spun at 4000 yards/minute (3658 meters/minute), from polymer of intrinsic viscosity 0.66, pigmented with 0.3% of $TiO_2$, essentially as in Example 4, except that the block temperature was 290° C., the pack pressure was 1400 psig, the spinneret capillaries were of diameter 62 mils and length 283 mils, 44 standard cubic feet per minute of cross-flow air were used over a distance extending 54 inches below the spinneret, and a different finish was used to give filaments of denier 2.21, which were not interlaced. These bundles were combined together to form a two of about 160,000 denier. The properties were measured on small bundles of filaments taken from the tow.

EXAMPLE 14

A tow was formed from 34-filament bundles spun at 3750 yards/minute (3429 meters/minute) from polymer of intrinsic viscosity 0.64, using a pack pressure of 1200 pisg but otherwise essentially as indicated in Example 13 to give filaments of 1.76 denier.

The filament tows of Examples 13 and 14 are not well suited for textile end-uses requiring critial dye uniformity, but should be acceptable in end-uses requiring excellent thermal stability such as in heavy denier denim warp yarns and in home furnishings.

TABLE 2

| Example | | 1 | 2 | 3 | 4 |
|---|---|---|---|---|---|
| Spin Speed ypm | | 4500 | 4500 | 4500 | 4500 |
| Block Temp. °C. | | 298 | 296 | 297 | 292 |
| Pack Press. psig | | 3500 | 4900 | 3800 | 4500 |
| Cap. (D×L) mils | | 9×50 | 9×50 | 12×17 | 10×40 |
| No. filaments | | 68 | 68 | 40 | 17+17 |
| Denier/filament | | 1.02 | 1.52 | 1.92 | 3.20 |
| Shape filament | | round | round | round | round |
| Air flow system | | 2" RAD | 4" RAD | XF | XF |
| Air rate SCFM | | 25 | 50 | 41 | 31 |
| Viscosity [η] | | 0.66 | 0.65 | 0.65 | 0.64 |
| $TiO_2$ | % | 0 | 0 | 0.3 | 0 |
| Tenacity | g/d | 3.18 | 3.14 | 2.84 | 3.04 |
| $T_7$ | g/d | 0.94 | 0.83 | 0.79 | 0.75 |
| Elongation | % | 74.6 | 84.3 | 87.5 | 89.5 |
| Modulus | g/d | 51.4 | 48.9 | 45.3 | 41.5 |
| $M_2$ | g/d | 54.5 | 42.1 | 45.0 | 43.3 |
| $M_n$ | g/d | 51.2 | 48.9 | 45.3 | 41.7 |
| $M_A$ | g/d | 32.4 | 32.8 | 31.3 | 29.7 |
| X | g/d | 18.8 | 16.1 | 14.0 | 12.0 |
| S | % | 3.6 | 4.7 | 4.8 | 5.1 |
| $S_2$ | % | 0.3 | (0.2E) | (0.2E) | (1.0E) |
| ST | g/d | .116 | .082 | .091 | .085 |
| $M_s$ | g/d | 3.22 | 1.75 | 1.90 | 1.67 |
| ρ | g/cm³ | 1.3707 | 1.3653 | 1.3614 | 1.3576 |
| CS | A | 71 | 67 | 71 | 70 |
| Biref. Δ | | .0883 | .0722 | .0647 | .0696 |
| DDR | | .148 | .153 | .126 | .091 |
| RDDR | | .100 | .127 | .118 | .110 |
| **Example** | | **5** | **6** | **7** | **8** |
| Spin Speed ypm | | 4500 | 4500 | 4500 | 4500 |
| Block Temp. °C. | | 302 | 296 | 290 | 298 |
| Pack Press. psig | | 2200 | 3700 | 1100 | 3200 |
| Cap. (D×L) mils | | 9×50 | 15×72 | 20×80 | 10×40 |
| No. filaments | | 34 | 34 | 17+17 | 40 |
| Denier/filament | | 1.49 | 3.88 | 2.16 | 1.84 |
| Shape filament | | trilobal | octalobal | round | round |
| Air flow system | | XF | XF | XF | XF |
| Air rate SCFM | | 44 | 31 | 19 | 31 |
| Viscosity [η] | | 0.65 | 0.65 | 0.59 | 0.67 |
| $TiO_2$ | % | 0.2 | 0 | 0.9 | 0.1 |
| Tenacity | g/d | 2.91 | 3.08 | 2.79 | 3.03 |
| $T_7$ | g/d | 0.04 | 0.83 | 0.70 | 0.01 |
| Elongation | % | 66.2 | 84.1 | 75.4 | 77.2 |
| Modulus | g/d | 49.6 | 50.6 | 44.6 | 49.3 |

TABLE 2-continued

| | | | | | |
|---|---|---|---|---|---|
| $M_2$ | g/d | 48.6 | 46.6 | 46.5 | 49.1 |
| $M_n$ | g/d | 49.6 | 50.6 | 45.9 | 48.9 |
| $M_A$ | g/d | 35.0 | 36.6 | 33.4 | 34.5 |
| X | g/d | 14.6 | 14.0 | 12.5 | 14.4 |
| S | % | 4.1 | 4.8 | 5.3 | 4.4 |
| $S_2$ | % | 0 | (0.3E) | (0.2E) | (0.4E) |
| ST | g/d | .111 | .073 | .098 | .085 |
| $M_s$ | g/d | 2.71 | 1.52 | 1.85 | 2.05 |
| $\rho$ | g/cm$^3$ | 1.3626 | 1.3615 | 1.3579 | 1.3624 |
| CS | A | 66 | 64 | 70 | 65 |
| Biref. Δ | | — | .0736 | .0652 | .0713 |
| DDR | | .152 | .102 | .123 | .122 |
| RDDR | | .125 | .136 | .123 | .112 |
| Example | | 9 | 10 | 11 | 12 |
| Spin Speed ypm | | 4750 | 5000 | 4500 | 4500 |
| Block Temp. °C. | | 302 | 295 | 290 | 293 |
| Pack Press. psig | | 3200 | 4200 | 3400 | 7200 |
| Cap. (D×L) mils | | 10×40 | 12×17 | 15×60 | 12×17 |
| No. filaments | | 40 | 80 | 80 | 40 |
| Denier/filament | | 1.86 | 1.88 | 1.86 | 1.83 |
| Shape filament | | round | round | Round | Round |
| Air flow system | | XF | XF | 2" Rad | XF |
| Air rate SCFM | | 31 | 41 | 17.5 | 37.5 |
| Viscosity [η] | | 0.65 | 0.65 | 0.65 | 0.65 |
| $TiO_2$ | % | 0.1 | 0.3 | 0.3 | 0.3 |
| Tenacity | g/d | 3.29 | 3.20 | 3.71 | 2.14 |
| $T_7$ | g/d | 0.94 | 0.90 | 0.92 | 0.90 |
| Elongation | % | 69.4 | 80.7 | 84.3 | 116.2 |
| Modulus | g/d | 54.1 | 54.0 | 47.5 | 46.5 |
| $M_2$ | g/d | 47.6 | 48.5 | 43.2 | 42.0 |
| $M_n$ | g/d | 54.1 | 54.0 | 47.5 | 46.5 |
| $M_A$ | g/d | 37.5 | 36.8 | 31.1 | 35.2 |
| X | g/d | 16.6 | 17.2 | 16.4 | 11.34 |
| S | % | 4.2 | 3.7 | 4.00 | 3.5 |
| $S_2$ | % | 0.8 | 0.7 | ≈0 | 0.1 |
| ST | g/d | .093 | .098 | .086 | 0.105 |
| $M_s$ | g/d | 2.21 | 2.65 | 2.15 | 3.0 |
| $\rho$ | g/cm$^3$ | 1.3664 | 1.3674 | 1.3659 | 1.3564 |
| CS | A | 72 | 72 | 53 | 69 |
| Biref. Δ | | .0710 | .0791 | .0841 | .0488 |
| DDR | | .102 | .121 | .117 | 0.162 |
| RDDR | | .194 | .111 | .107 | 0.148 |
| Example | | 13 | 14 | | |
| Spin Speed ypm | | 4000 | 3750 | | |
| Block Temp. °C. | | 290 | 290 | | |
| Pack Press. psig | | 1400 | 1200 | | |
| Cap. (D×L) mils | | 62×283 | 62×283 | | |
| No. filaments | | 17+17 | 17+17 | | |
| Denier/filament | | 2.21 | 1.76 | | |
| Shape filament | | round | round | | |
| Air flow system | | XF | XF | | |
| Air rate SCFM | | 44 | 44 | | |
| Viscosity [η] | | 0.66 | 0.64 | | |
| $TiO_2$ | % | 0.3 | 0.3 | | |
| Tenacity | g/d | 2.66 | 2.67 | | |
| $T_7$ | g/d | 0.99 | 0.94 | | |
| Elongation | % | 72.6 | 75.6 | | |
| Modulus | g/d | 53.6 | 51.0 | | |
| $M_2$ | g/d | 51.5 | 52.5 | | |
| $M_n$ | g/d | 53.4 | 51.2 | | |
| $M_A$ | g/d | 35.3 | 33.5 | | |
| X | g/d | 18.1 | 17.7 | | |
| S | % | 3.4 | 3.3 | | |
| $S_2$ | % | ≈0 | ≈0 | | |
| ST | g/d | 0.079 | 0.069 | | |
| $M_s$ | g/d | 2.32 | 2.03 | | |
| $\rho$ | g/cm$^3$ | 1.3693 | 1.3683 | | |
| CS | A | 70 | 72 | | |
| Biref. Δ | | .0710 | .0679 | | |
| DDR | | .131 | .142 | | |
| RDDR | | .130 | .126 | | |

TABLE 3

| EX. | DS, % | DTV, % | IEU, % | $\Delta_{95\text{-}6}$ | $\frac{\Delta}{20}$ + .0055 |
|---|---|---|---|---|---|
| 1 | 3.1 | 0.62 | 9.52 | .0031 | .0099 |
| 2 | 3.1 | 0.29 | 8.25 | .0062 | .0091 |
| 3 | 3.4 | 0.34 | 8.11 | .0076 | .0087 |
| 4 | 2.2 | 0.15 | 7.95 | .0083 | .0090 |

TABLE 3-continued

| EX. | DS, % | DTV, % | IEU, % | $\Delta_{95\text{-}6}$ | $\frac{\Delta}{20}$ + .0055 |
|---|---|---|---|---|---|
| 5 | 8.1 | 0.83 | 10.41 | — | — |
| 6 | 3.9 | 0.84 | 9.38 | .0103 | .0092 |
| 7 | 6.4 | 0.30 | 7.91 | .0038 | .0088 |
| 8 | 7.3 | 0.78 | 8.51 | .0059 | .0091 |
| 9 | 5.3 | 0.99 | 9.03 | .0059 | .0091 |
| 10 | 7.4 | 1.62 | 8.00 | .0088 | .0095 |
| 11 | 2.3 | 0.13 | 10.51 | .0024 | .0097 |
| 12 | 7.0 | 0.51 | 10.68 | .0103 | .0079 |
| 13 | — | — | 9.97 | — | .0091 |
| 14 | — | — | 8.56 | .0192 | .0089 |

We claim:

1. A flat yarn comprising continuous filaments of poly(ethylene terephthalate) of 1 to 7 denier per filament, and intrinsic viscosity [η] 0.56 to 0.68, characterized by:

(1) a relative disperse dye rate of at least 0.09, (2) a modulus of about 30 to about 65 grams/denier, when measured on the yarn as-produced (M) and after being boiled in water at atmospheric pressure for 60 minutes ($M_2$), (3) an amorphous modulus ($M_A$) of from about 28 to about 38 grams/denier, where the amorphous moduus is related to the modulus (M), the intrinsic viscosity [η] and the density of the poly(ethylene terephthalate) (ρ) according to the expression:

$$M_A=(0.65/[\eta])^{0.3}M-X$$

where X is given by the expression:

$$X=530(\rho-1.335)(0.65/[\eta])^{0.3}$$

and the X value is between 5 and 25, (4) a boil-off shrinkage (S) of about 2% to about 6%, and (5) a thermal stability such that the shrinkage value $S_2$ is less than 1%.

2. A flat yarn according to claim 1, wherein the crystal size (CS) is from about 50 to about 90Å, and is at least a value depending on the density of the poly(ethylene terephthalate) (ρ) according to the relationship:

$$CS \geqq 1430\ (\rho-1.335)\text{Å}.$$

3. A flat yarn according to claim 1, wherein the birefringence is from about 0.045 to about 0.09.

4. A flat yarn according to claim 1, wherein $\Delta M \leqq 5$ where ΔM is the difference between modulus values of the yarn measured in grams per denier (1) on the as-produced yarn and (2) on the shrunk yarn after boil-off shrinkage, respectively.

5. A flat yarn according to claim 1, wherein the crystal size (CS) is from about 50 to about 90 Å, and is at least a value depending on the density of the poly(ethylene terephthalate) (ρ) according to the relationship:

$$CS \geqq 1430(\rho-1.335)\ \text{Å}$$

wherein the birefringence is from about 0.045 to about 0.09 and wherein $\Delta M \leqq 5$, where ΔM is the difference between the modulus values of the yarn measured in grams per denier (1) on the as-produced yarn and (2) on the shrunk yarn after boil-off shrinkage, respectively.

6. A flat yarn according to claim 1, wherein the relative disperse dye rate is at least 0.11.

7. A continuous filament flat yarn according to claim 1 wherein the denier spread (DS) is less than about 6%, draw tension variation (DTV) is less than about 1.2%, interfilament elongation uniformity (IEU) is better than about 12.5%, and differential birefringence (Δ95-5) is less than about a value depending on the average birefringence (Δ), measured plus or minus 5% away from the filament center, according to the relation: $\Delta 95\text{-}5 \leqq \Delta/20+0.0055$ and wherein Δ is about 0.045 to about 0.09.

8. A flat yarn according to claim 1, wherein the denier per filament is 1 to 2.

9. A flat yarn according to claim 1, wherein the amorphous modulus is 28 to 36.5 grams/denier.

10. A flat yarn according to claim 1, wherein the boil-off shrinkage is about 2% to about 4%.

11. A flat yarn comprising continuous filaments of poly(ethylene terephthalate) of 1 to 7 denier per filament, and intrinsic viscosity [η] 0.56 to 0.68, and having a relative disperse dye rate of at least 0.11, modulus of 30 to 65 grams/denier when measured on the yarn (1) as-produced and (2) after being boiled in water at atmospheric pressure for 60 minutes, and $\Delta M \leqq 5$, where ΔM is the difference between such modulus values (1) and (2), amorphous modulus of 28 to 38 grams/denier and X value of 5 to 25, boil-off shrinkage 2% to 6%, and thermal stability such that the shrinkage value $S_2$ is less than 1%.

12. A flat yarn according to claim 11, wherein the boil-off shrinkage is 2% to 4%.

13. A continuous filament flat yarn according to claim 11 wherein the denier spread (DS) is less than about 6%, draw tension variation (DTV) is less than about 1.2%, interfilament elongation uniformity (IEU) is better than about 12.5%, and differential birefringence (Δ95-5) is less than about a value depending on the average birefringence (Δ), measured plus or minus 5% away from the filament center, according to the relation: $\Delta 95\text{-}5 \leqq \Delta/20+0.0055$ and wherein Δ is about 0.045 to about 0.09.

14. A flat yarn comprising continuous filaments of poly(ethylene terephthalate) of 1 to 7 denier per filament, and intrinsic viscosity [η] 0.56 to 0.68, characterized by:

(1) a relative disperse dye rate of at least 0.09, (2) a modulus of about 30 to about 65 grams/denier, when measured on the yarn as-produced (M) and after being boiled in water at atmospheric pressure for 60 minutes ($M_2$), (3) an amorphous modulus ($M_A$) of from about 28 to about 38 grams/denier, where the amorphous modulus is related to the modulus (M), the intrinsic viscosity [η] and the density of the poly(ethylene terephthalate) (ρ) according to the expression:

$$M_A=(0.65/[\eta])^{0.3}M-X$$

where X is given by the expression:

$$X=530\ (\rho-1.335)(0.65/[\eta])^{0.3}$$

and the X value is between 5 and 25, (4) a shrinkage modulus ($M_s$) of about 1.5 to about 3.5 grams per denier, and (5) a thermal stability such that the shrinkage value $S_2$ is less than 1%.

15. A flat yarn according to claim 14, wherein the boil-off shrinkage is about 2% to about 6%.

16. A flat yarn according to claim 14, wherein the boil-off shrinkage is about 2% to about 4%.

17. A flat yarn according to claim 14, wherein the crystal size (CS) is from about 50 to about 90 Å, and is at least a value depending on the density of the poly(ethylene terephthalate) (ρ) according to the relationship:

$$CS \geqq 1430(\rho-1.335)\text{Å}.$$

18. A flat yarn according to claim 14, wherein the birefringence is from about 0.045 to about 0.09.

19. A flat yarn according to claim 14, wherein $\Delta M \leqq 5$, where ΔM is the difference between the modulus values of the yarn measured in grams per denier (1) on the as-produced yarn and (2) on the shrunk yarn after boil-off shrinkage, respectively.

20. A flat yarn according to claim 14, wherein the crystal size (CS) is from about 50 to about 90 Å, wherein the birefringence is from about 0.05 to about 0.09 and wherein $\Delta M \leqq 5$, where ΔM is the difference between the modulus values of the yarn measured in grams per denier (1) on the as-produced and (2) on the shrunk yarn after boil-off shrinkage, respectively.

21. A flat yarn according to claim 14, wherein the relative disperse dye rate is about least 0.11.

22. A flat yarn according to claim 14, wherein the denier per filament is less than 2.

23. A flat yarn according to claim 14, wherein the amorphous modulus is 28 to 36.5 grams/denier.

24. A continuous filament flat yarn according to claim 14, wherein the denier spread (DS) is less than about 6%, draw tension variation (DTV) is less than about 1.2%, interfilament elongation uniformity (IEU) is better than about 12.5%, and differential birefringence (Δ95-5) is less than about a value depending on the average birefringence (Δ), measured plus or minus 5% away from the filament center, according to the relation: $\Delta 95\text{-}5 \leqq \Delta/20+0.0055$ and wherein Δ is about 0.045 to about 0.09.

25. A flat yarn comprising continuous filaments of poly(ethylene terephthalate) of 1 to 7 denier per filament, and intrinsic viscosity [η] 0.56 to 0.68, and having a relative disperse dye rate of at least 0.11 modulus of 30 to 65 grams/denier when measured on the yarn (1) as produced and (2) after being boiled in water at atmospheric pressure for 60 minutes, and $\Delta M \leqq 5$, where ΔM is the difference between such modulus values (1) and (2), amorphous modulus of 28 to 38 grams/denier and X value of 5 to 25, shrinkage modulus of 1.5 to 3.5 grams/denier, and thermal stability such that the shrinkage value $S_2$ is less than 1%.

26. A flat yarn according to claim 25, wherein the boil-off shrinkage is 2% to 6%.

27. A flat yarn according to claim 25, wherein the boil-off shrinkage is 2% to 4%.

28. A continuous filament flat yarn according to claim 25 wherein the denier spread (DS) is less than about 6%, draw tension variation (DTV) is less than about 1.2%, interfilament elongation uniformity (IEU) is better than about 12.5%, and differential birefringence (Δ95-5) is less than about a value depending on the average birefringence (Δ), measured plus or minus 5% away from the filament center, according to the relation: $\Delta 95\text{-}5 \leqq \Delta/20+0.0055$ and wherein Δ is about 0.045 to about 0.09.

29. A polyester flat yarn comprising continuous filaments of poly(ethylene terephthalate) of 1 to 4 denier per filament, tenacity 2.0 to 4.0 grams per denier, elongation 40 to 125%, modulus 30 to 65 grams/denier, amorphous modulus 28 to 35 grams/denier and X value of 5 to 25, boil-off shrinkage 2% to 6%, shrinkage modulus of 1.5 to 3.5 grams/denier, thermal stability such that the value $S_2$ is less than 1%, intrinsic viscosity 0.56 to 0.68, crystal size 50 to 90 Å and at least 1430 $(\rho-1.335)$Å where $\rho$ is the density of the poly(ethylene terephthalate) and is 1.35 to 1.38, birefringence 0.045 to 0.09, and of relative disperse dye rate at least 0.11.

30. A flat yarn according to claim 29, wherein the boil-off shrinkage is 2% to 4%.

31. A continuous filament flat yarn according to claim 29 wherein the denier spread (DS) is less than about 6%, draw tension variation (DTV) is less than about 1.2%, interfilament elongation uniformity (IEU) is better than about 12.5%, and differential birefringence (Δ95-5) is less than about a value depending on the average birefringence (Δ), measured plus or minus 5% away from the filament center, according to the relation: $\Delta 95\text{-}5 \leqq \Delta/20+0.0055$ and wherein Δ is about 0.045 to about 0.09.

32. A polyester flat yarn comprising continuous filaments of poly(ethylene terephthalate) of 1 to 2 denier per filament, intrinsic viscosity 0.56 to 0.68, tenacity 2.0 to 4.0 grams per denier, elongation 40 to 125%, modulus 30 to 65 grams/denier, amorphous modulus 28 to 35 grams/denier and X value of 5 to 25, boil-off shrinkage 2% to 6%, shrinkage modulus of 1.5 to 3.5 grams/denier, thermal stability such that the value $S_2$ is less than 1%, crystal size 50 to 90 Å and at least 1430 $(\rho-1.335)$Å, where $\rho$ is the density of the poly(ethylene terephthalate) and is 1.35 to 1.38, birefringence 0.045 to 0.09, and of relative disperse dye rate of at least 0.11.

33. A flat yarn according to claim 32, wherein the boil-off shrinkage is 2% to 4%.

34. A continuous filament flat yarn according to claim 32 wherein the denier spread (DS) is less than about 6%, draw tension variation (DTV) is less than about 1.2%, interfilament elongation uniformity (IEU) is better than about 12.5%, and differential birefringence (Δ95-5) is less than about a value depending on the average birefringence (Δ), measured plus or minus 5% away from the filament center, according to the relation: $\Delta 95\text{-}5 \leqq \Delta/20+0.0055$ and wherein Δ is about 0.045 to about 0.09.

35. A two comprising continuous filaments of poly(ethylene terephthalate) of 1 to 7 denier per filament, and intrinsic viscosity $[\eta]$ 0.56 to 0.68, characterized by:

(1) a relative disperse dye rate of at least 0.09, (2) a modulus of about 30 to about 65 grams/denier, when measured on the tow as-produced (M) and after being boiled in water at atmospheric pressure for 60 minutes ($M_2$), (3) an amorphous modulus ($M_A$) of from about 28 to about 38 grams/denier, where the amorphous modulus is related to the modulus (M), the intrinsic viscosity $[\eta]$ and the density of the poly(ethylene terephthalate) ($\rho$) according to the expression:

$$M_A=(0.65/[\eta])^{0.3}\,M-X$$

where X is given by the expression:

$$X=530\,(\rho-1.335)(0.65/[\eta])^{0.3}$$

and the X value is between 5 and 25, (4) a boil-off shrinkage (S) of about 2% and about 6%, and (5) a thermal stability such that the shrinkage value $S_2$ is less than 1%.

36. A two according to claim 35, wherein the crystal size (CS) is from about 50 to about 90 Å, and is at least a value depending on the density of the poly(ethylene terephthalate) ($\rho$) according to the relationship:

$$CS \geqq 1430(\rho-1.335)\ \text{Å}.$$

37. A tow according to claim 35, wherein the birefringence is from about 0.045 to about 0.09.

38. A tow according to claim 35, wherein $\Delta M \leqq 5$ where ΔM is the difference between modulus values of the tow measured in grams per denier (1) on the as-produced tow and (2) on the shrunk tow after boil-off shrinkage, respectively.

39. A tow according to claim 35, wherein the crystal size (CS) is from about 50 to about 90 Å, and is at least a value depending on the density of the poly(ethylene terephthalate) ($\rho$) according to the relationship:

$$CS \geqq 1430(\rho-1.335)\ \text{Å}$$

wherein the birefringence is from about 0.045 to about 0.09 and wherein $\Delta M \leqq 5$, where Δ M is the difference between the modulus values of the tow measured in grams per denier (1) on the as-produced tow and (2) on the shrunk tow after boil-off shrinkage, respectively.

40. A tow according to claim 35, wherein the relative disperse dye rate is at least 0.11.

41. A continuous filament tow accordding to claim 35 wherein the denier spread (DS) is less than about 6%, draw tension variation (DTV) is less than about 1.2%, interfilament elongation uniformity (IEU) is better than about 12.5%, and differential birefringence (Δ95-5) is less than about a value depending on the average birefringence (Δ), measured plus or minus 5% away from the filament center, according to the relation: $\Delta 95\text{-}5 \leqq \Delta/20+0.0055$ and wherein Δ is about 0.045 to about 0.09.

42. A tow according to claim 35, wherein the denier per filament is 1 to 2.

43. A tow according to claim 35, wherein the amorphous modulus is 28 to 36.5 grams/denier.

44. A tow according to claim 35, wherein the boil-off shrinkage is about 2% to about 4%.

45. A tow comprising continuous filaments of poly(ethylene terephthalate) of 1 to 7 denier per filament, and intrinsic viscosity $[\eta]$ 0.56 to 0.68, and having a relative disperse dye rate of at least 0.11, modulus of 30 to 65 grams/denier when measured on the tow (1) as-produced and (2) after being boiled in water at atomospheric pressure for 60 minutes, and $\Delta M \leqq 5$, where ΔM is the difference between such modulus values (1) and (2), amorphous modulus of 28 to 38 grams/denier and X value of 5 to 25, boil-off shrinkage 2% to 6%, and thermal stability such that the shrinkage value $S_2$ is less than 1%.

46. A tow according to claim 45, wherein the boil-off shrinkage is 2% to 4%.

47. A continuous filament tow according to claim 45 wherein the denier spread (DS) is less than about 6%, draw tension variation (DTV) is less than about 1.2%, interfilament elongation uniformity (IEU) is better than about 12.5%, and differential birefringence (Δ95-5) is less than about a value depending on the average birefringence (Δ), measured plus or minus 5% away from the filament center, according to the relation: Δ95-

$5 \leqq \Delta/20+0.0055$ and wherein $\Delta$ is about 0.045 to about 0.09.

48. A tow comprising continuous filaments of poly(ethylene terephthalate) of 1 to 7 denier per filament, and intrinsic viscosity $[\eta]$ 0.56 to 0.68, characterized by:

(1) a relative disperse dye rate of at least 0.09, (2) a modulus of about 30 to about 65 grams/denier, when measured on the tow as-produced (M) and after being boiled in water at atmospheric pressure for 60 minutes ($M_2$), (3) an amorphous modulus ($M_A$) of from about 28 to about 38 grams/denier, where the amorphous modulus is related to the modulus (M), the intrinsic viscosity $[\eta]$ and the density of the poly(ethylene terephthalate) ($\rho$) according to the expression:

$$M_A=(0.65/[\eta])^{0.3}\,M-X$$

where X is given by the expression:

$$X=530(\rho-1.335)(0.65/[\eta])^{0.3}$$

and the X value is between 5 and 25, (4) a shrinkage modulus ($M_s$) of about 1.5 to about 3.5 grams per denier, and (5) a thermal stability such that the shrinkage value $S_2$ is less than 1%.

49. A tow according to claim 48, wherein the boil-off shrinkage is about 2% to about 6%.

50. A tow according to claim 48, wherein the boil-off shrinkage is about 2% to about 4%.

51. A tow according to claim 48, wherein the crystal size (CS) is from about 50 to about 90Å, and is at least a value depending on the density of the poly(ethylene terephthalate) ($\rho$) according to the relationship:

$$CS \geqq 1430(\rho-1.335)\,\text{Å}.$$

52. A tow according to claim 48, wherein the birefringence is from about 0.045 to about 0.09.

53. A tow according to claim 48, wherein $\Delta M \leqq 5$, where $\Delta M$ is the difference between the modulus values of the tow measured in grams per denier (1) on the as-produced tow and (2) on the shrunk tow after boil-off shrinkage, respectively.

54. A tow according to claim 48, wherein the crystal size (CS) is from about 50 to about 90 Å, wherein the birefringence is from about 0.05 to about 0.09 and wherein $\Delta M \leqq 5$, where $\Delta M$ is the difference between the modulus values of the tow measured in grams per denier (1) on the as-produced tow and (2) on the shrunk tow after boil-off shrinkage, respectively.

55. A tow according to claim 48, wherein the relative disperse dye rate is at least 0.11.

56. A tow according to claim 48, wherein the denier per filament is less than 2.

57. A tow according to claim 48, wherein the amorphous modulus is 28 to 36.5 grams/denier.

58. A continuous filament tow according to claim 48 wherein the denier (DS) is less than about 6%, draw tension variation (DTV) is less than about 1.2%, interfilament elongation uniformity (IEU) is better than 12.5%, and differential birefringence ($\Delta$95-5) is less than about a value depending on the average birefringence ($\Delta$), measured plus or minus 5% away from the filament center, according to the relation:

$$\Delta_{95\text{-}5} \leqq (\Delta/20)+0.0055$$

and wherein $\Delta$ is about 0.045 to about 0.09.

59. A tow comprising continuous filaments of poly(ethylene terephthalate) of 1 to 7 denier per filament, and intrinsic viscosity $[\eta]$ 0.56 to 0.68, and having a relative disperse dye rate of at least 0.11 modulus of 30 to 65 grams/denier when measured on the tow (1) as-produced and (2) after being boiled in water at atmospheric pressure for 60 minutes, and $\Delta M \leqq 5$, where $\Delta M$ is the difference between such modulus values (1) and (2), amorphous modulus of 28 to 38 grams/denier and X value of 5 to 25, shrinkage modulus of 1.5 to 3.5 grams/denier, and thermal stability such that the shrinkage value $S_2$ is less than 1%.

60. A tow according to claim 59 wherein the boil-off shrinkage is 2% to 6%.

61. A tow according to claim 59, wherein the boil-off shrinkage is 2% to 4%.

62. A continuous filament tow according to claim 59 wherein the denier spread (DS) is less than about 6%, draw tension variation (DTV) is less than about 1.2%, interfilament elongation uniformity (IEU) is better than about 12.5%, and differential birefringence ($\Delta$95-5) is less than about a value depending on the average birefringence ($\Delta$), measured plus or minus 5% away from the filament center, according to the relation: $\Delta 95\text{-}5 \leqq \Delta/20+0.0055$ and wherein $\Delta$ is about 0.045 to about 0.09.

63. A polyester tow comprising continuous filaments of poly(ethylene terephthalate) of 1 to 4 denier filament, tenacity 2.0 to 4.0 grams per denier, elongation 40 to 125% modulus 30 to 65 grams/denier, amorphous modulus 28 to 35 grams/denier and X value of 5 to 25, boil-off shrinkage 2% to 6%, shrinkage modulus of 1.5 to 3.5 grams/denier, thermal stability such that the value $S_2$ is less than 1%, intrinsic viscosity 0.56 to 0.68, crystal size 50 to 90Å and at least $1430(\rho-1.335)$Å where $\rho$[is the density of the poly(ethylene terephthalate) and is 1.35 to 1.38, birefringence 0.045 to 0.09, and of relative disperse dye rate at least 0.11.

64. A tow according to claim 63, wherein the boil-off shrinkage is 2% to 4%.

65. A continuous filament tow according to claim 63 wherein the denier spread (DS) is less than about 6%, draw tension variation (DTV) is less than about 1.2%, interfilament elongation uniformity (IEU) is better than about 12.5%, and differential birefringence ($\Delta$95-5) is less than about a value depending on the average birefringence ($\Delta$), measured plus or minus 5% away from the filament center, according the relation: $\Delta 95\text{-}5 \leqq (\Delta/20)+0.0055$ and wherein $\Delta$ is about 0.045 to about 0.09.

66. A polyester tow comprising continuous filaments of poly(ethylene terephthalate) of 1 to 2 denier per filament, intrinsic viscosity 0.56 to 0.68, tenacity 2.0 to 4.0 grams per denier, elongation 40 to 125%, modulus 30 to 65 grams/denier, amorphous modulus 28 to 35 grams/denier and X value of 5 to 25, boil-off shrinkage 2% to 6%, shrinkage modulus of 1.5 to 3.5 grams/denier, thermal stability such that the value $S_2$ is less than 1%, crystal size 50 to 90Å, where $\rho$ is the density of the poly(ethylene terephthalate) and is 1.35 to 1.38, birefringence 0.045 to 0.09, and of relative disperse dye rate at least 0.11.

67. A tow according to claim 66, wherein the boil-off shrinkage is 2% to 4%.

68. A continuous filament tow according to claim 66 wherein the denier spread (DS) is less than about 6%, draw tension variation (DTV) is less than about 1.2%, interfilament elongation uniformity (IEU) is better than about 12.5%, and differential birefringence (Δ95-5) is less than about a value depending on the average birefringence (Δ), measured plus or minus 5% away from the filament center, according to the relation $\Delta 95\text{-}5 \leqq (\Delta/20)+0.0055$ and wherein A is about 0.045 to about 0.09.

69. Poly(ethylene terephthalate) staple fiber of 1 to 7 denier, and intrinsic viscosity [η] 0.56 to 0.68, characterized by:

(1) a relative disperse dye rate of at least 0.09 as defined herein above, (2) a modulus of about 30 to about 65 grams/denier, when measured on the staple fiber as-produced (M) and after being boiled in water at atmospheric pressure for 60 minutes ($M_2$), (3) an amorphous modulus ($M_A$) of from about 28 to about 38 grams/denier, where the amorphous modulus is related to the modulus (M), the intrinsic viscosity [η] and the density of the poly(ethylene terphthalate) (ρ) according to the expression:

$$M_A=(0.65/[\eta])^{0.3}\,M-X$$

where X is given by the expression:

$$X=530(\rho-1.335)(0.65/[\eta])^{0.3}$$

and the X value is between 5 and 25, (4) a boil-off shrinkage (S) of up to about 6%, and (5) a thermal stability such that the shrinkage value $S_2$ is less than 1%.

70. Staple fiber according to claim 69, wherein the boil-off shrinkage (S) is about 2% to about 4%.

71. A staple fiber according to claim 69, wherein the denier is less than 2.

72. Poly(ethylene terephthalate) staple fiber of 1 to 7 denier, intrinsic viscosity [η] 0.56 to 0.68, characterized by:

(1) a relative disperse dye rate of at least 0.09, (2) a modulus of about 30 to about 65 grams/denier, both measured on the fiber as-produced (M) and after being boiled in water at atmospheric pressure for 60 minutes ($M_2$), (3) an amorphous modulus ($M_A$) of from about 28 to about 38 grams/denier, wherein the amorphous modulus is related to the modulus (M), the intrinsic viscosity [η] and the density of the poly(ethylene terephthalate) (ρ) according to the expression:

$$M_A=(0.65/[\eta])^{0.3}\,M-X$$

where X is given by the expression:

$$X=530(\rho-1.335)(0.65/[\eta])^{0.3}$$

and the X value is between 5 and 25, and (4) a shrinkage modulus ($M_s$) of about 1.5 to about 3.5 grams per denier, and (5) a thermal stability such that the value $S_2$ is less than 1%.

73. Staple fiber according to claim 72, wherein the boil-off shrinkage (S) is about 2% to about 4%.

74. Staple fiber according to claim 72 wherein the denier is less than 2.

75. Poly(ethylene terephthalate) staple fiber of 1 to 4 denier per filament, modulus 30 to 65 grams/denier amorphous modulus 28 to 35 grams/denier and X value of 5 to 25, boil-off shrinkage of 2% to 6%, shrinkage modulus of 1.5 to 3.5 grams/denier thermal stability such that the value $S_2$ is less than 1%, intrinsic viscosity [η] 0.56 to 0.68, crystal size 50 to 90Å and at least 1430 (ρ−1.335)Å, where is the density of the poly(ethylene terephthalate) and is ρ 1.35 to 1.38, birefringence 0.045 to 0.09, and of relative disperse dye rate at least 0.11.

76. Staple fiber according to claim 75, wherein the differential birefringence (Δ95-5) is less than about a value depending on the average birefringence (Δ), measured plus or minus 5% away from the filament center, according to the relation: $\Delta(95\text{-}5) \leqq (\Delta/20)+0.0055$ and wherein Δ is about 0.045 to about 0.09.

77. Staple fiber according to claim 75, wherein the boil-off shrinkage is about 2% to about 4%.

78. Staple fiber according to claim 75 wherein the denier is less than 2.

79. Poly(ethylene terephthalate) staple fiber of 1 to 7 denier, and having a relative disperse dye rate of at least 0.11, modulus of 30 to 65 grams/denier when measured on the fiber (1) as-produced and (2) after being boiled in water at atmospheric pressure for 60 minutes, and $\Delta M \leqq 5$, where Δ M is the difference between such modulus values (1) and (2), amosphous modulus of 28 to 38 grams/denier and X value of 5 to 25, boil-off shrinkage from 2% to 6%, and thermal stability such that the shrinkage value $S_2$ is less than 1%.

80. Staple fiber according to claim 79, wherein the boil-off shrinkage is 2% to 4%.

81. Poly(ethylene terephthalate) staple fiber of 1 to 7 denier, and having a relative disperse dye rate of at least 0.11, modulus of 30 to 65 grams/denier when measured on the fiber (1) as-produced and (2) after being boiled in water at atmospheric pressure for 60 minutes, and $\Delta M \leqq 5$, where ΔM is the difference between such modulus values (1) and (2), amorphous modulus of 28 to 38 grams/denier and X value of 5 to 25, shrinkage modulus of 1.5 to 3.5 grams/denier, and thermal stability such that the shrinkage value $S_2$ is less than 1%.

82. Staple fiber according to claim 81, wherein the boil-off shrinkage is 2% to 6%.

83. Staple fiber according to claim 81, wherein the boil-off shrinkage is 2% to 4%.

* * * * *

UNITED STATES PATENT OFFICE

CERTIFICATE OF CORRECTION

PATENT NO. : 4,156,071

DATED : May 22, 1979

INVENTOR(S) : Benjamin H. Knox

It is certified that error appears in the above-identified patent and that said Letters Patent are hereby corrected as shown below:

Column 18 - Table 2 - line 33 (Block Temp. °C) under (Example) 3
"297" should read -- 295 --.

Column 18 - Table 2 - line 67 ($T_7$) under (Example) 5
"0.04" should read -- 0.94 --.

under (Example) 7
"0.70" should read -- 0.79 --.

under (Example) 8
"0.01" should read -- 0.81 --.

Column 19 - Table 2 - line 36 (RDDR) under (Example) 9
".194" should read -- .094 --.

Signed and Sealed this

*Twenty-third* Day of *September 1980*

[SEAL]

*Attest:*

SIDNEY A. DIAMOND

*Attesting Officer*

*Commissioner of Patents and Trademarks*